United States Patent [19]

Lilly

[11] Patent Number: 4,872,410

[45] Date of Patent: Oct. 10, 1989

[54] FOLDABLE PLAYTRAY

[76] Inventor: Carol Lilly, 5354 Highland Dr., Bellevue, Wash. 98006

[21] Appl. No.: 136,117

[22] Filed: Dec. 21, 1987

[51] Int. Cl.[4] ..... A47B 85/00

[52] U.S. Cl. ..... 108/26; 108/13; 108/62; 108/132; 446/128

[58] Field of Search ..... 108/62, 43, 12, 44, 108/26, 13, 14, 17, 19, 33, 36, 123, 130, 131, 132; 446/128, 71

[56] References Cited

U.S. PATENT DOCUMENTS

| | | | |
|---|---|---|---|
| D. 252,977 | 9/1979 | Bayly | 446/71 X |
| 2,956,849 | 10/1960 | Dow | 108/62 X |
| 2,986,438 | 5/1961 | Smathers et al. | 108/44 X |
| 3,759,192 | 9/1973 | Oehler | 108/44 |
| 3,859,930 | 1/1975 | Sherwin | 297/439 X |
| 4,010,696 | 3/1977 | Priesman | 108/44 X |
| 4,052,944 | 10/1977 | Jennings | 108/44 X |

FOREIGN PATENT DOCUMENTS

| | | | |
|---|---|---|---|
| 817148 | 7/1969 | Canada | 108/25 |
| 1049484 | 11/1966 | United Kingdom | 446/128 |

*Primary Examiner*—Peter A. Aschenbrenner
*Assistant Examiner*—Thomas A. Rendos
*Attorney, Agent, or Firm*—Seed and Berry

[57] ABSTRACT

A foldable playtray is provided having a table supported by a pair of legs hinged to the table in such a way that both surfaces of the table may be used. One surface of the table is provided with a Lego-type play surface so a child playing with Lego-type toys can detachably secure them to the table. The other surface of the table is flat, for use for games, arts and crafts. The legs can be rotated so they support the table with either its Lego-type play surface or its flat surface on top. In addition, the legs are provided with a Lego-type play surface and can be rotated to be coplanar with the table to provide an extended Lego-type play surface. The legs are also equipped with covered storage compartments for small objects. A storage bag and the table are provided with complimentary velcro type fasteners arranged in such a way the velcro can be used to not only attach the storage bag to the table, but they can also be used to close the storage bag when it is detached from the table.

10 Claims, 4 Drawing Sheets

FIG. 10
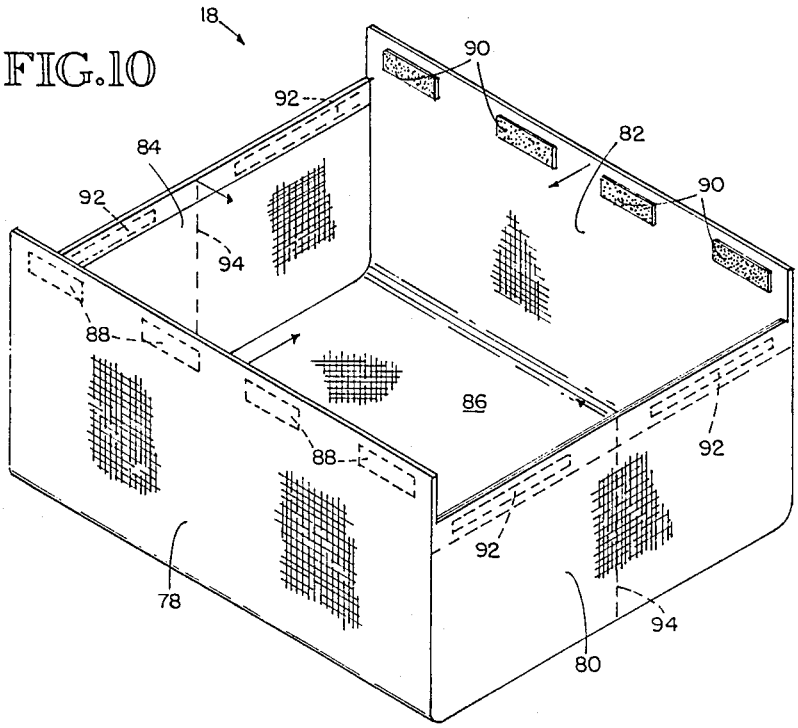
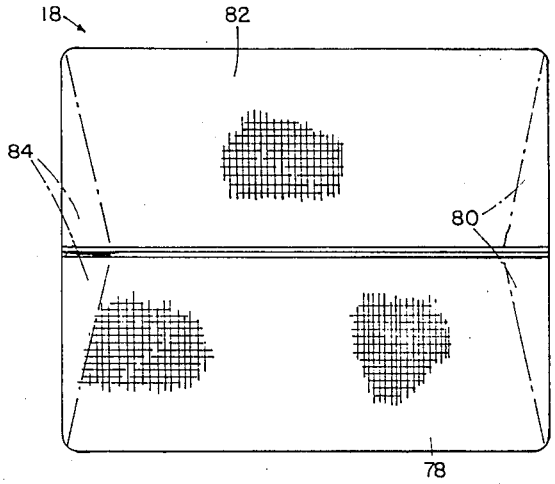
FIG. 11

FOLDABLE PLAYTRAY

BACKGROUND OF THE INVENTION

The present invention relates to trays with legs, and more particularly, it relates to a particular kind of such a tray which is designed for use by children while engaged in certain play activities.

BRIEF SUMMARY OF THE INVENTION

Certain types of building blocks and toys detachably snap together. Each such building block or toy is provided with a regular array of cylindrical bumps on one surface and a corresponding regular array of recesses on another surface which are adapted to engage such bumps. Thus, by engaging the bumps on one building block or toy with the recesses on another such building block or toy, the building blocks and toys can be detachably snapped together. Such building blocks and toys are very common and popular, and are sold under such brand names as Lego and Tyco.

For clarity and consistency of terminology, such building blocks and toys will be referred to hereafter as simply "Lego-type toys". Similarly, a flat surface covered by a regular array of such cylindrical bumps or recesses will be referred to hereafter as simply a "Lego-type play surface". However, it is to be clearly understood that the terminology "Lego-type toys" and "Lego-type play surface" are not intended to be limited to the exact kinds of bumps and recesses found on existing Lego and Tyco snap together building blocks and toys. Instead, such terminology is intended to include any type of building block or toy having complimentary attachment means which permit the building blocks or toys to be detachably snapped together.

In basic form, the playtray of the present invention comprises a table having a Lego-type play surface on its top side and a flat surface on its bottom side. The table is equipped with a pair of legs which are hinged to the table in such a way that allows both the top and bottom surfaces of the table to be used.

In a first configuration, the legs are rotated at right angles with respect to the table and support the table with its Lego-type play surface on top, thereby enabling a child to comfortably sit with his or her legs extended beneath the table, and to attach Lego-type toys to it.

In a second configuration, the legs are rotated until they are coplanar with respect to the table to provide an extended Lego-type play surface, since the upper surface of each leg is also equipped with a Lego-type play surface.

In a third configuration, the table is turned over so its flat surface is on top, with the playtray's legs being rotated down until they are at right angles with respect to the table so they support it. In this configuration, the playtray may be used as a bed or television tray; or its flat surface may be used as a writing surface or as a play surface for puzzles, drawing, arts, crafts or games.

In a fourth configuration, the legs are rotated until they are coplanar with respect to the table to provide an extended flat surface, since each leg is flat on one side.

In a fifth configuration, the legs are both rotated flat against the flat side of the table, for compact storage.

The legs are provided with storage compartments for small objects such as pens, pencils, crayons, etc., and are provided with doors to keep the stored objects secure until needed. The doors open outwardly for easy access when the playtray is in its third and fourth configurations.

The playtray is equipped with a detachable storage bag for Lego type toys or other objects. The storage bag is secured to the table by velcro-type fasteners. A first side of the table has hook type velcro, while the second side of the table has loop type velcro. The storage bag has just the opposite arrangement of velcro. That is, it has loop type velcro on its first side and hook type velcro on its second side. This arrangement of velcro permits the storage bag to be secured to the table when the playtray is not in use, with the storage bag being located neatly beneath the table and between its legs. This arrangement of velcro also permits the velcro on the storage bag to be used to close the storage bag neatly and securely when the storage bag is removed from the playtray for any reason.

The foregoing is intended to be a brief summary of, not a detailed catalog of, the various objects, features, advantages and characteristics of the playtray of the present invention since these and other objects, features, advantages and characteristics of the present invention will be expressly or inherently dislosed to those skilled in the art to which it pertains in view of all of the disclosures contained in this document.

BRIEF DESCRIPTION OF THE DRAWINGS

FIG. 10 is a perspective view of the playtray's storage bag in an open configuration; and FIG. 11 is a top plan view of the playtray's storage bag in a closed configuration.

DETAILED DESCRIPTION OF THE PREFERRED EMBODIMENTS

Figure 1:
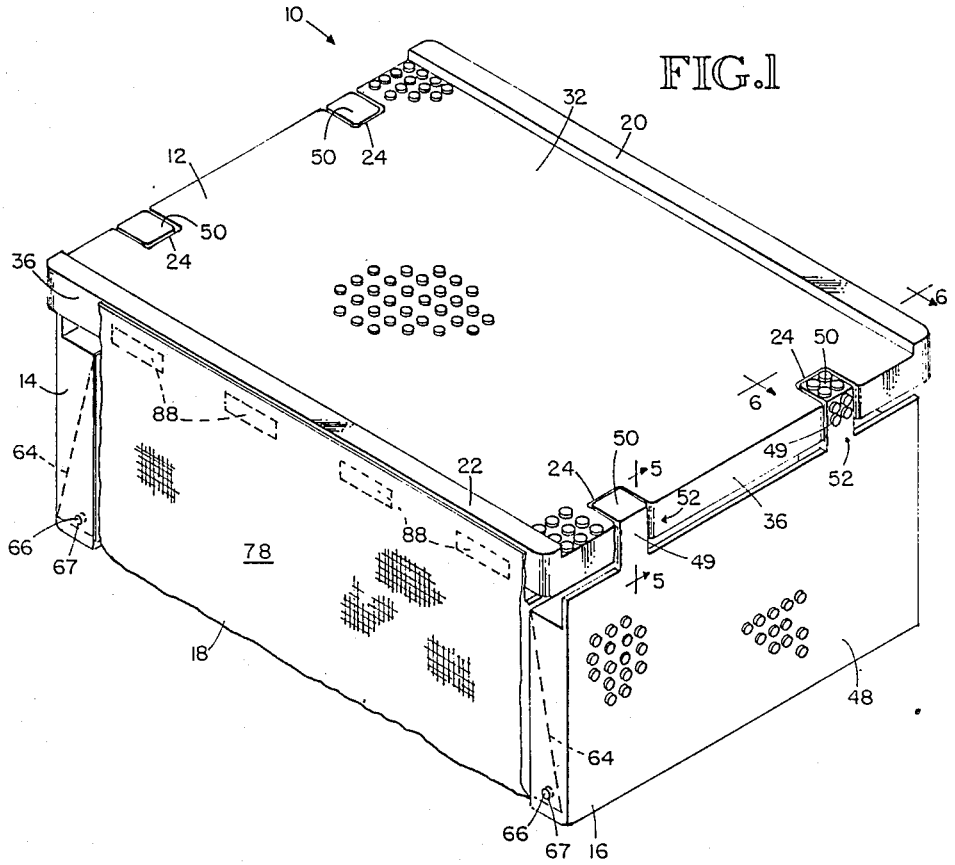
FIG. 1 is a perspective view of the playtray of the present invention in a first playing configuration with its storage bag attached.

Turning now to FIG. 1, the playtray of the present invention is generally designated at 10 and comprises four major components, namely a table 12, a pair of storage legs 14, 16 and a storage bag 18.

Figure 5:
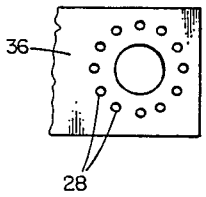
FIG. 5 is a partial plan view taken along line 5—5 of FIG. 1.
Figure 6:
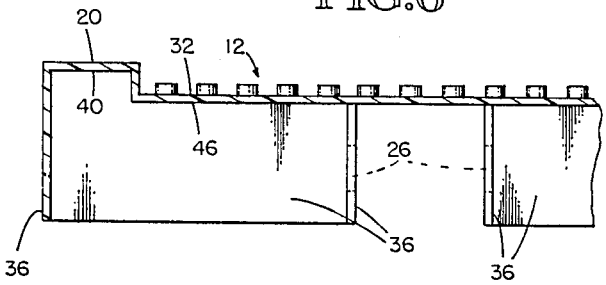
FIG. 6 is a partial cross sectional view taken along line 6—6 of FIG. 1.

Table 12 has a pair of flat topped, raised edges 20, 22; four hinge recesses 24, and a Lego-type play surface 32. As best seen in FIG. 5, a circular hinge hole 26, which is surrounded by a circular array of hemispherical latching recesses 28, is provided in both sides of each hinge recess 24. Table 12's play surface 32 extends fully between edges 20, 22, and also extends the full length of table 12.

Figure 3:
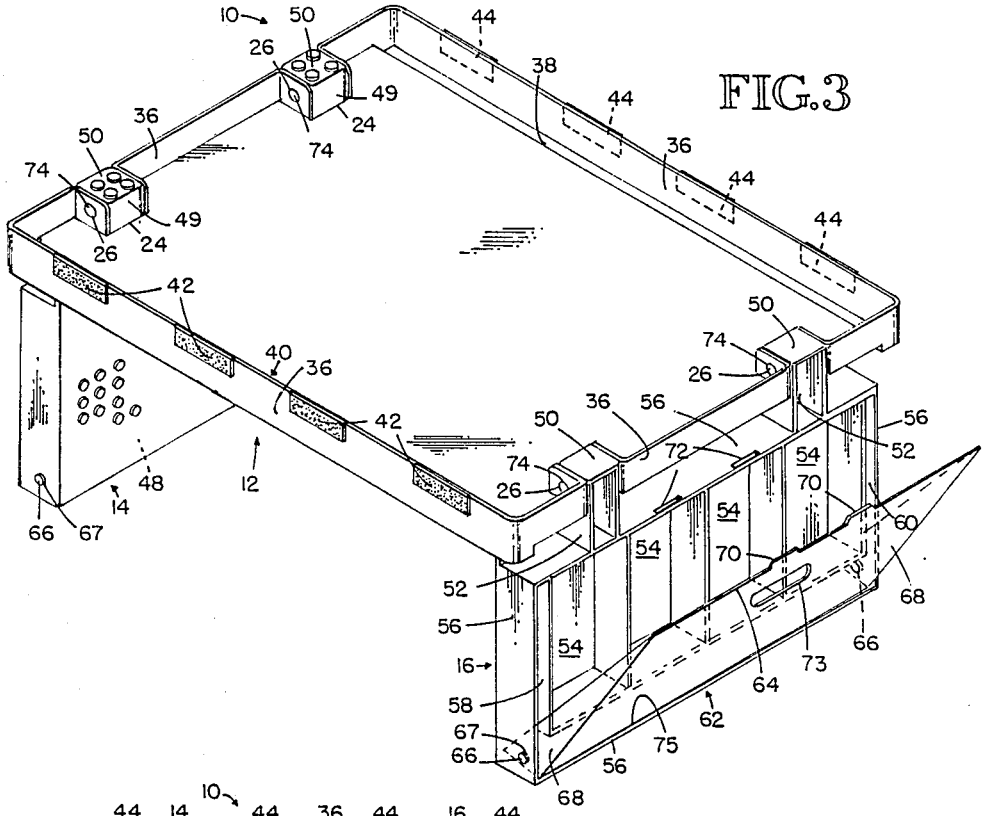
FIG. 3 is a perspective view of the playtray of the present invention turned over in a third playing configuration with its flat side up and with its storage bag removed.

As best seen in FIG. 3, table 12 is completely surrounded by a peripheral reinforcing edge 36 which is continuous except where broken at the inner edge of each hinge recess 24. Since table 12 is preferably formed of plastic of relatively uniform thickness, a pair of pencil trays 38, 40 are formed by the underside of raised edges 20, 22. The peripheral edge 36 of table 12 is provided with patches of loop type velcro 42 on one side and with patches of hook type velcro 44 on the other side. Each patch of velcro 42, 44 is affixed to peripheral edge 36 by any conventional means, such as by gluing, and is preferably located in a respective shallow recess in peripheral edge 36 to help prevent its edges from being accidentally snagged which might cause it to be accidentally torn off. The bottom surface 46 of body 12 is flat.

Turning now to a consideration of the playtray's storage legs 14, 16, as best seen in FIG. 1, the top surface 48 of each storage leg is completely covered with a Lego-type play surface; as are the top and end surfaces 49, 50 of each of its hinge arms 52.

Figure 7:
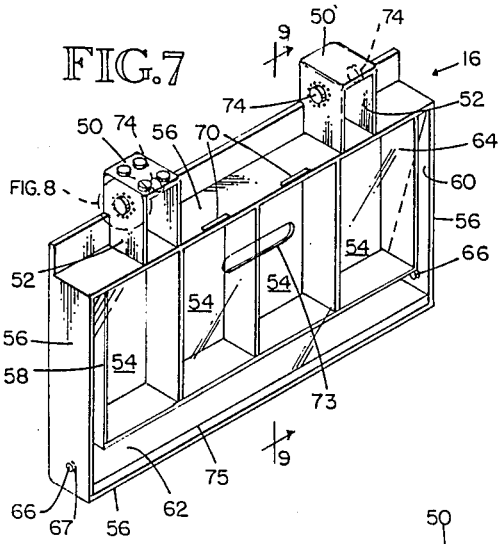
FIG. 7 is a perspective view of one of the playtray's storage legs showing its storage compartments and door.
Figure 9:
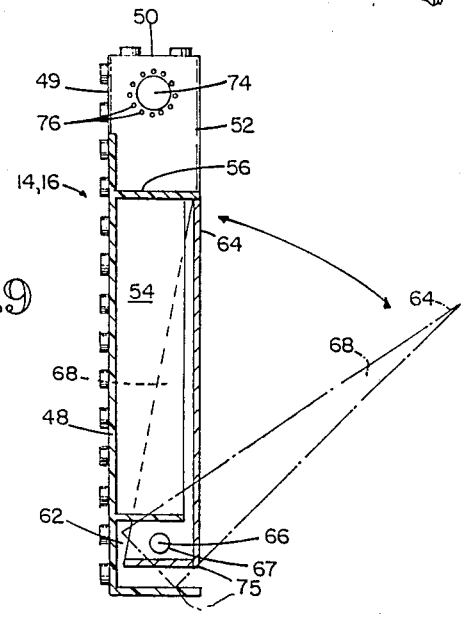
FIG. 9 is a cross sectional view taken along line 9—9 of FIG. 7.

Referring now to FIGS. 3, 7 and 9, each storage leg 14, 16 includes several storage compartments 54, which are separated from the peripheral wall 56 of storage leg 14, 16 by side recesses 58, 60 and by bottom recess 62.

Each storage leg 14, 16 includes a cover 64 having a pair of hinge pins 66 which are received in corresponding hinge holes in the peripheral wall 56 of storage leg 14, 16. When cover 64 is closed (see FIG. 7), its sides 68 fit into side recesess 58, 60, while its latch ears 70 hold it securely closed by fitting into corresponding latch slots 72 in peripheral wall 56.

A finger hole 73 is provided in each cover 64, so the user can conveniently pull cover 64 open as desired. As best seen in FIGS. 3 and 9, rotation of cover 64 is preferably stopped by the bottom front edge 75 of cover 64 contacting the bottom portion of peripheral wall 56 when cover 64 is at about a 45° angle with respect to storage leg 14, 16. If desired, the bottom front edge 75 of cover 64 could, of course, be made rounded enough to permit cover 64 to open at a right angle with respect to storage leg 12, 14. In addition, a retaining wall could be located across the lower portion of each storage compartment 54, to prevent stored articles from spilling out when cover 64 is opened.

Figure 8:
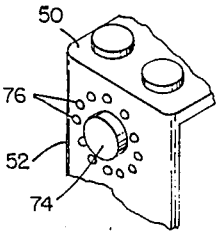
FIG. 8 is a partial perspective view showing the hinge and latch arrangement on the playtray's storage legs.

As best seen in FIGS. 7–9, two sides of each hinge arm 52 of storage legs 14, 16 are each provided with a hinge pin 74 surrounded by a circular array of hemispherical latch bumps 76. Each hinge pin 74 is received in a corresponding hinge hole 26 in table 12. Similarly, each latch bump 76 is releasably received in a corresponding latch recess 28 in table 12 as storage legs 14, 16 are rotated with respect to table 12 into the different configurations seen in FIGS. 14. Latch bumps 76 and latch recesses 28 are, of course, arranged to releasably lock storage legs 14, 16 into the various positions with respect to table 12 which are seen in FIGS. 1–4. It is to be understood that the hinge and latch mechanism 74, 76, 26, 28 is conventional, and may be replaced with any conventional hinge and latch mechanism which will releasably lock storage legs 14, 16 into the various configurations seen in FIGS. 1–4.

Table 12; storage legs 14, 16; and covers 64 are each preferably molded separately in one piece from any strong, durable, crack resistent plastic, although they could each also, of course, be molded as several component pieces which would then be assembled and/or glued together in any suitable conventional way. In addition, the plastic used must be resilient enough to permit the insertion of hinge pins 66 of covers 64 into their corresponding hinge holes, to permit latch ears 70 on covers 64 to be releasably engaged by latch slots 72, to permit hinge pins 74 of storage arms 14, 16 to be inserted into hinge holes 26 in table 12, and to permit latch bumps 76 on storage legs 14, 16 to be releasably received by latch recesses 28 in table 12.

Turning now to FIG. 10, storage bag 18 is preferably sewn, in any conventional fashion, from cloth, and has sides 78, 80, 82, 84 and a bottom 86. Sewn to the top of side 78 are hook type velcro patches 88 (adapted to mate with the loop type velcro patches 42 on table 12); while sewn to the top of the opposing side 82 are loop type velcro patches 90 (adapted to mate with the hook type velcro patches 44 on table 12). Sewn into the top edges of the other two sides 80, 84 are stays 92.

When storage bag 18 is removed from table 12 and is to be closed, its sides 78, 80, 82 84 are moved towards each other in the directions indicated by the arrows in FIG. 10. Because of stays 92, its sides 80, 84 bend inwardly along fold lines 94 until velcro patches 88, 90 can mate with each other, thereby securely closing the storage bag 18, as seen in FIG. 11.

Storage bag 18 is preferably made of thin, strong, flexible material, such as cloth or plastic, to enable it to be closed in the manner just described. In addition, such a construction allows the child to more easily sort through the Lego-type toys without having to remove them from storage bag 18. However, it could be made from a stiff, rigid material, if such features were not desired. Similarly, although velcro patches 42, 44, 88, 90 on table 12 and storage bag 18 are preferred, any other conventional releasable fastening means could be used, such as snaps, etc.

As has been mentioned, the playtray 10 of the present invention has several playing configurations. In FIG. 1, the storage legs 14, 16 are folded down to support the table 12 in an elevated position with its Lego-type play surface 32 uppermost. As seen in FIG. 1, since the end surfaces 50 of the hinge arms 52 of the storage legs 14, 16 have a Lego-type play surface, the table 12's Lego-type play surface 32 is essentially unbroken. Storage bag 18 can be removed from table 12 by disengaging velcro patches 42, 44, 88, 90 from each other, such as when access to the Lego-type toys or other articles stored therein is desired. In addition, removal of storage bag 18 permits the user to comfortably extend his or her legs under table 12 while using playtray 10.

Figure 2:
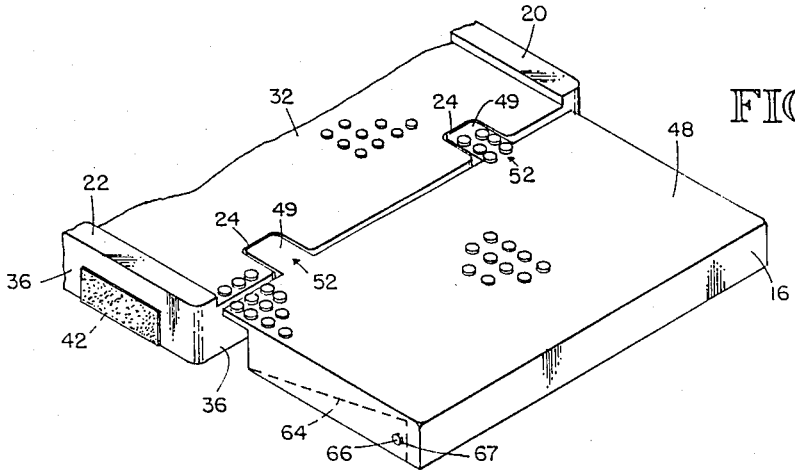
FIG. 2 is a partial perspective view of the playtray of the present invention in a second playing configuration with its storage bag removed and with its storage legs outstretched to form an extended play surface.

FIG. 2 illustrates the manner in which, when the storage bag 18 is removed, both of the storage legs 14, 16 can be rotated out horizontally to create an extended Lego-type play surface 32, 49, 48. Here again, since the top surface 49 of the hinge arms 52 of storage legs 14, 16 are equipped with a Lego-type play surface, said extended Lego-type play surface 32, 49, 48 is essentially unbroken.

In FIG. 3, the playtray 10 has been turned over and its storage legs rotated 180° with respect to their position seen in FIG. 1, so the playtray 10's flat bottom surface 46 can be used for any desired activity such as drawing, eating, etc. Here again, storage bag 18 could be secured to playtray 10 by mating velcro patches 42, 44, 88, 90; or it could be removed, as seen, to permit access to its contents or to permit the user to comfortably extend his or her legs under table 12 while using playtray 10.

Figure 4:
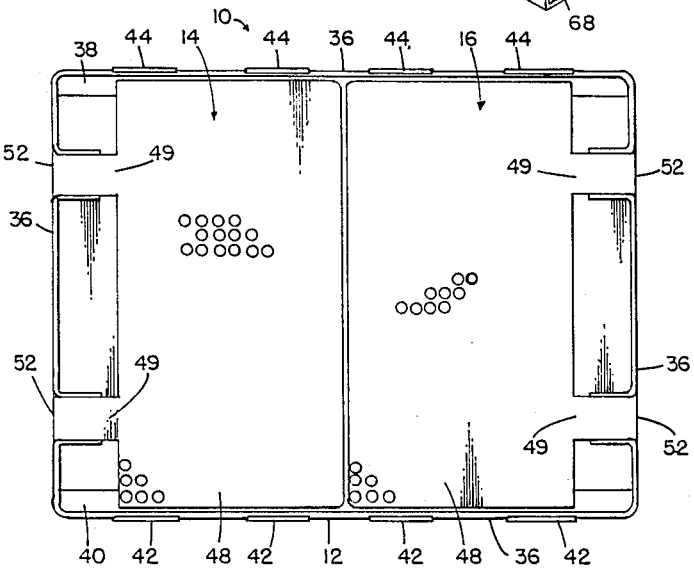
FIG. 4 is a plan view of the playtray of the present invention with its storage bag removed and with its storage legs folded flat.

In FIG. 4, playtray 10 has been folded up for storage by rotating its storage legs 14, 16 against flat surface 46.

From the foregoing various further applications, modifications and adaptations of the playtray of the present invention will now be expressly or inherently disclosed to those skilled in the art to which it pertains, within the scope of the claims which follow. It is to be understood that all of the descriptions of the present invention contained in this document were, in all respects, strictly by way of non-limiting example.

What is claimed is:

1. A playtray comprising:

a table having a play surface which at least substantially comprises a play surface with regularly spaced protruding coupling elements;

a pair of legs, at least one of said legs having a first surface which at least substantially comprises a play surface with regularly spaced protruding coupling elements; and hinges pivotally connecting said legs to said table in at least first and second configurations;

latches operable to selectively lock said legs in said first and second configurations, wherein in said first configuration said leg support said table with said table play surface uppermost, and wherein in said second configuration said legs are outstretched generally coplanar with respect to said table and said first leg surface and table play surface provide the playtray with an extended, substantially unbroken play surface with regularly spaced protruding coupling elements.

2. A playtray according to claim 1, wherein said hinges pivotally connect said legs to said table in a third configuration in which said legs are folded at least generally flat against an underside of said table opposite said table play surface for compact storage of said playtray, and said latches are operable to selectively lock said legs in said third configuration.

3. A playtray according to claim 1, wherein said table has an underside opposite said table play surface which is at least substantially a flat surface.

4. A playtray according to claim 1, wherein said at least one of said legs has at least one hinge arm with a first surface which at least substantially comprises a play surface with regularly spaced protruding coupling elements which is uppermost when said legs are in said second configuration to provide an at least substantially unbroken, play surface with regularly spaced protruding coupling elements for said playtray.

5. A playtray according to claim 1:

wherein said table is made from sheet material of a relatively uniform thickness;

wherein said table play surface includes a pair of opposed, raised lateral edges which are raised above the rest of said table play surface; and wherein said opposed, raised lateral edges form corresponding opposed lateral edge troughs in an underside surface of said table opposite said table play surface which are depressed below the rest of said underside surface.

6. A playtray comprising:

a table having a play surface which at least substantially comprises a play surface with regularly spaced protruding coupling elements;

a pair of legs;

hinges pivotally connecting said legs to said table in at least a first configuration, each of said legs having at least one hinge arm with an end surface which is a play surface with regularly spaced protruding coupling elements to provide an at least substantially unbroken, play surface with regularly spaced protruding coupling elements for said playtray when said legs are in said first configuration; and latches operable to selectively lock said legs in said first configuration, wherein in said first configuration said legs support said table with said table play surface uppermost.

7. A playtray comprising:

a table having a first surface;

a pair of legs; and hinge and latch means for pivotally connecting and latching said legs to said table in at least first and second configurations, in said first configuration said legs support said table with said first surface uppermost, wherein at least one of said legs includes:

a body defining at least one storage compartment;

a cover;

hinge means for pivotally connecting said cover to said body; and latch means for releasably holding said cover closed with respect to said body.

8. A playtray according to claim 7:

wherein said hinge means are located towards one end of said body and said cover; and wherein said cover includes a stop portion which is sized and arranged to stop the rotation of said cover by contacting said body when said cover is at a predetermined angle with respect to said body.

9. A playtray according to claim 7:

wherein said body further defines a bottom recess and a pair of side recesses;

wherein said cover includes a front, a bottom and a pair of sides; and wherein when said cover is closed, said pair of sides of said cover fit within said pair of side recesses and said bottom of said cover fits within said bottom recess.

10. A playtray comprising:

a table having a first surface;

a pair of legs;

hinge and latch means for pivotally connecting said latching said legs to said table in at least first and second configurations, in said first configuration said legs support said table with said first surface uppermost;

a storage bag; and means for releasably attaching said storage bag to said table when said playtray is in at least one of said first and second configurations, wherein said means for releasably attaching includes:

a hook type fastener secured to a first side of said table;

a loop type fastener secured to a second side of said table;

a loop type fastener secured to a first side of said storage bag; and a hook type fastener secured to a second side of said storage bag to permit said fastener on said first and second sides of said storage bag to be releasably attached to said fastener on said first and second sides of said table, respectively, and to permit said fastener on said first and second sides of said storage bag to be releasably attached to each other to securely close said storage bag when said storage bag is not secured to said playtray.

* * * * *